US010278506B2

(12) United States Patent
Yang

(10) Patent No.: US 10,278,506 B2
(45) Date of Patent: May 7, 2019

(54) FOLDING CHAIR WITH ARMRESTS

(71) Applicant: TOPSUN CREATIVE DESIGN, Hangzhou, Zhejiang (CN)

(72) Inventor: Baoqing Yang, Zhejiang (CN)

(73) Assignee: TOPSUN CREATIVE DESIGN, Hangzhou, Zhejiang (CN)

( * ) Notice: Subject to any disclaimer, the term of this patent is extended or adjusted under 35 U.S.C. 154(b) by 211 days.

(21) Appl. No.: 15/300,371

(22) PCT Filed: Mar. 31, 2016

(86) PCT No.: PCT/CN2016/077942
§ 371 (c)(1),
(2) Date: Sep. 29, 2016

(87) PCT Pub. No.: WO2016/155636
PCT Pub. Date: Oct. 6, 2016

(65) Prior Publication Data

US 2017/0181547 A1 Jun. 29, 2017

(30) Foreign Application Priority Data

Mar. 31, 2015 (CN) ..... 2015 2 0190182 U

(51) Int. Cl.
*A47C 4/28* (2006.01)
*A47C 4/30* (2006.01)

(52) U.S. Cl.
CPC ..... *A47C 4/28* (2013.01); *A47C 4/283* (2013.01); *A47C 4/286* (2013.01); *A47C 4/30* (2013.01)

(58) Field of Classification Search
CPC ..... A47C 4/283; A47C 4/286; A47C 4/28
See application file for complete search history.

(56) References Cited

U.S. PATENT DOCUMENTS 3,635,520 A * 1/1972 Roher ..... A47C 4/286 108/118
4,715,650 A * 12/1987 Berman ..... A47C 4/02 297/28

(Continued)

FOREIGN PATENT DOCUMENTS

CN 2540842 Y 3/2003
CN 2561282 Y 7/2003

(Continued)

OTHER PUBLICATIONS

International Search Report for PCT/CN2016/077942, dated Jun. 22, 2016, ISA/CN.

*Primary Examiner* — David R Dunn
*Assistant Examiner* — Tania Abraham
(74) *Attorney, Agent, or Firm* — Yue (Robert) Xu; Apex Attorneys at Law, LLP

(57) ABSTRACT

A folding chair with armrests includes a chair frame which includes a left crossed tube structure consisting of a first left crossing tube and a second left crossing tube crossed with and hinged to each other, and a right crossed tube structure consisting of a first right crossing tube and a second right crossing tube crossed with and hinged to each other. The chair frame further includes two backrest tubes, two armrest tubes and two armrest support tubes, lower ends of the two backrest tubes are respectively hinged to the first left crossing tube and the first right crossing tube, two backrest sliders are respectively sleeved on middle portions of the two backrest tubes, and the two backrest sliders are respectively hinged to the second left crossing tube and the second right crossing tube, and one end of each armrest tube is hinged to a respective backrest tube.

6 Claims, 3 Drawing Sheets

(56) References Cited

U.S. PATENT DOCUMENTS

| | | | | |
|---|---|---|---|---|
| 4,717,201 | A * | 1/1988 | Barras | A47C 4/38 297/16.2 |
| 6,149,238 | A * | 11/2000 | Tsai | A47C 4/286 297/188.14 |
| 6,419,311 | B1 * | 7/2002 | Tang | A47C 1/026 297/411.35 |
| 6,454,348 | B1 * | 9/2002 | Wu | A47C 4/286 297/16.2 |
| 6,547,322 | B2 * | 4/2003 | Marx | A47C 4/286 297/360 |
| 6,634,705 | B1 * | 10/2003 | Zheng | A47C 4/286 297/41 |
| 6,814,403 | B2 * | 11/2004 | Zheng | A47C 4/00 297/16.2 |
| 6,840,574 | B1 * | 1/2005 | Wu | A47C 4/20 297/188.14 |
| 6,926,356 | B2 * | 8/2005 | Chen | A47C 4/286 297/35 |
| 7,802,844 | B1 * | 9/2010 | Vencill | A47C 4/02 297/16.2 |
| 8,100,469 | B2 * | 1/2012 | Lougee | A47C 4/286 297/452.3 |
| 8,864,222 | B2 * | 10/2014 | Grace | A47C 4/286 297/35 |
| 2012/0175917 | A1 * | 7/2012 | Chen | A47C 4/286 297/29 |
| 2013/0193722 | A1 * | 8/2013 | Zhu | A47C 4/286 297/16.1 |
| 2014/0138990 | A1 * | 5/2014 | Chesness | A47C 4/286 297/35 |
| 2014/0217784 | A1 * | 8/2014 | Chen | A47C 7/42 297/35 |

FOREIGN PATENT DOCUMENTS

| | | | |
|---|---|---|---|
| CN | 2574525 | Y | 9/2003 |
| CN | 102309169 | A | 1/2012 |
| CN | 202604187 | U | 12/2012 |
| CN | 204654310 | U | 9/2015 |
| JP | 2009005738 | A | 1/2009 |

* cited by examiner

FOLDING CHAIR WITH ARMRESTS

This application is the national phase of International Application No. PCT/CN2016/077942, titled "FOLDING CHAIR WITH ARMRESTS", filed on Mar. 31, 2016, which claims the benefit of priority to Chinese Patent Application No. 201520190182.3 titled "FOLDING CHAIR WITH ARMRESTS", filed with the Chinese State Intellectual Property Office on Mar. 31, 2015, the entire disclosures of both applications are incorporated herein by reference.

FIELD

The present application relates to a folding chair with armrests.

BACKGROUND

Folding chairs have features of being portable and foldable, thus being convenient to move and space saving. A folding chair made of thickened steel tubes and an oxford cloth is widely used in home, outdoors and leisure places. In this type of folding chairs, a spray treatment is performed on the surface of the steel tubes, thus the steel tubes are rustproof and aesthetic; and a technological mechanical treatment is performed on critical stressed portions, thus the load bearing capacity of the chair is greatly enhanced. The specification of the oxford cloth mainly includes 600 D and 800 D, and most of folding beds have a structure of double-layer cloth, which improves the service life and comfort of the seat surface. Folding and linking portions are linked by galvanized rivets and original plastic members, and designs, such as a meshed cup bag, an operation panel, a storage bag, a footrest, a sun visor, and armrests, are additionally provided according to characteristics of different products. In most conventional folding chairs with armrests, two ends of a fabric, such as oxford cloth, are directly fixed on rod members of the folding chair, to allow the fabric, such as the oxford cloth, supported by the rod members to function as the armrests. The fabric such as the oxford cloth is soft, thus, when the elbows are placed thereon, the fabric will cave in. Also, the soft fabric have different tightness at different parts occasionally, thus, the two armrests may have different heights, which adversely affects using experience.

SUMMARY

An object of the present application is to overcome the deficiencies in the conventional technology, to provide a folding chair with armrests which has a reasonable structural design, and the armrests of the folding chair may not cave in, to improve using experience.

To address the above issues, the following technical solutions are employed in the present application.

A folding chair with armrests includes a chair frame and a fabric provided on the chair frame. The chair frame includes a left crossed tube structure and a right crossed tube structure, the left crossed tube structure consists of a first left crossing tube and a second left crossing tube crossed with and hinged to each other, and the right crossed tube structure consists of a first right crossing tube and a second right crossing tube crossed with and hinged to each other. The chair frame further includes two backrest tubes, two armrest tubes and two armrest support tubes, lower ends of the two backrest tubes are respectively hinged to the first left crossing tube and the first right crossing tube, two backrest sliders are respectively sleeved on middle portions of the two backrest tubes, and the two backrest sliders are respectively hinged to the second left crossing tube and the second right crossing tube, one end of each of the two armrest tubes is hinged to a respective one of the two backrest tubes, upper ends of the two armrest support tubes are respectively connected to the two armrest tubes, and lower ends of the two armrest support tubes are respectively connected to the second left crossing tube and the second right crossing tube. With such structure, since the armrest tubes are used as the armrest members, the issue of the armrests being caved in when the elbows are placed thereon is avoided, also the situation that using experience is adversely affected due to height difference between the two armrests is avoided. In practical folding process, the armrest tube can be rotated with respect to the backrest tube by taking the end of the armrest tube as a pivot point, so as to be folded, and the normal folding function of the folding chair will not be interfered.

Preferably, the chair frame further includes a front crossed tube structure and a rear crossed tube structure, the front crossed tube structure consists of a first front crossing tube and a second front crossing tube crossed with and hinged to each other, the rear crossed tube structure consists of a first rear crossing tube and a second rear crossing tube crossed with and hinged to each other, a lower end of the first front crossing tube and a lower end of the second left crossing tube are both hinged to a first hinging seat, an upper end of the first front crossing tube and an upper end of the first right crossing tube are both hinged to a second hinging seat, a lower end of the second front crossing tube and a lower end of the second right crossing tube are both hinged to a third hinging seat, an upper end of the second front crossing tube and an upper end of the first left crossing tube are both hinged to a fourth hinging seat, a lower end of the first rear crossing tube and a lower end of the first left crossing tube are both hinged to a fifth hinging seat, an upper end of the first rear crossing tube and an upper end of the second right crossing tube are both hinged to a sixth hinging seat, a lower end of the second rear crossing tube and a lower end of the first right crossing tube are both hinged to a seventh hinging seat, an upper end of the second rear crossing tube and an upper end of the second left crossing tube are both hinged to an eighth hinging seat, and the second hinging seat, the fourth hinging seat, the sixth hinging seat and the eighth hinging seat are respectively fixedly connected to four corners of the seat fabric for supporting a human body.

Preferably, an armrest slider is fixed on each of the two armrest tubes, the armrest slider is provided with a sliding slot, and an upper end of the respective armrest support tube is slidably arranged in the sliding slot of the armrest slider, to allow the armrest slider to connect the armrest support tube to the armrest tube. With such structure, the armrest tube may be rotated with respect to the backrest tube by a greater angle by taking the end of the armrest tube as a pivot point, thus the armrest tube may get closer to the backrest tube, and the folding effect of the armrest tube may be improved.

Preferably, middle portions of the two armrest support tubes are respectively hinged to the first left crossing tube and the first right crossing tube, two support tube sliders are respectively sleeved on the second left crossing tube and the second right crossing tube, and are respectively slidable on the second left crossing tube and the second right crossing tube, and lower ends of the two armrest support tubes are respectively hinged to the two support tube sliders. With such structure, the folding effect is ensured, and further when the chair frame of the folding chair is unfolded, the upper end of the armrest tube is immovable, which restricts the upper end of the armrest support tube from sliding with respect to the sliding slot in the armrest slider, thereby preventing the armrest tube from swaying.

Preferably, in a case that the folding chair is unfolded to be in a using state and is placed on a horizontal ground, horizontal heights of the second hinging seat and the fourth hinging seat are higher than horizontal heights of the sixth hinging seat and the eighth hinging seat. With such structure, when the seat fabric, configured to support the human body, of the folding chair is unfolded, it may present a state of being high at the front and low at the rear. The conventional seat fabric is in a horizontal state, thus a person may slip forward when sitting thereon for a long time, and since the seat fabric has the structure of being high at the front and low at the rear, the above defect is effectively addressed, which improves the comfort level, and the comfort in sitting is thus improved.

Compared with the conventional technology, the present application has the following advantages and effects. Since the armrest tubes are used as the armrest members, the issue of the armrests being caved in when the elbows are placed thereon is avoided, and also the situation that using experience is adversely affected due to height difference between the two armrests is avoided. In practical folding process, the armrest tube can be rotated with respect to the backrest tube by taking the end of the armrest tube as a pivot point, so as to be folded, and the normal folding function of the folding chair will not be interfered.

DETAILED DESCRIPTION

The present application is further described in detail hereinafter with reference to drawings and embodiments, the following embodiments are explanations to the present application, and the present application is not limited to the following embodiments.

Figure 1:
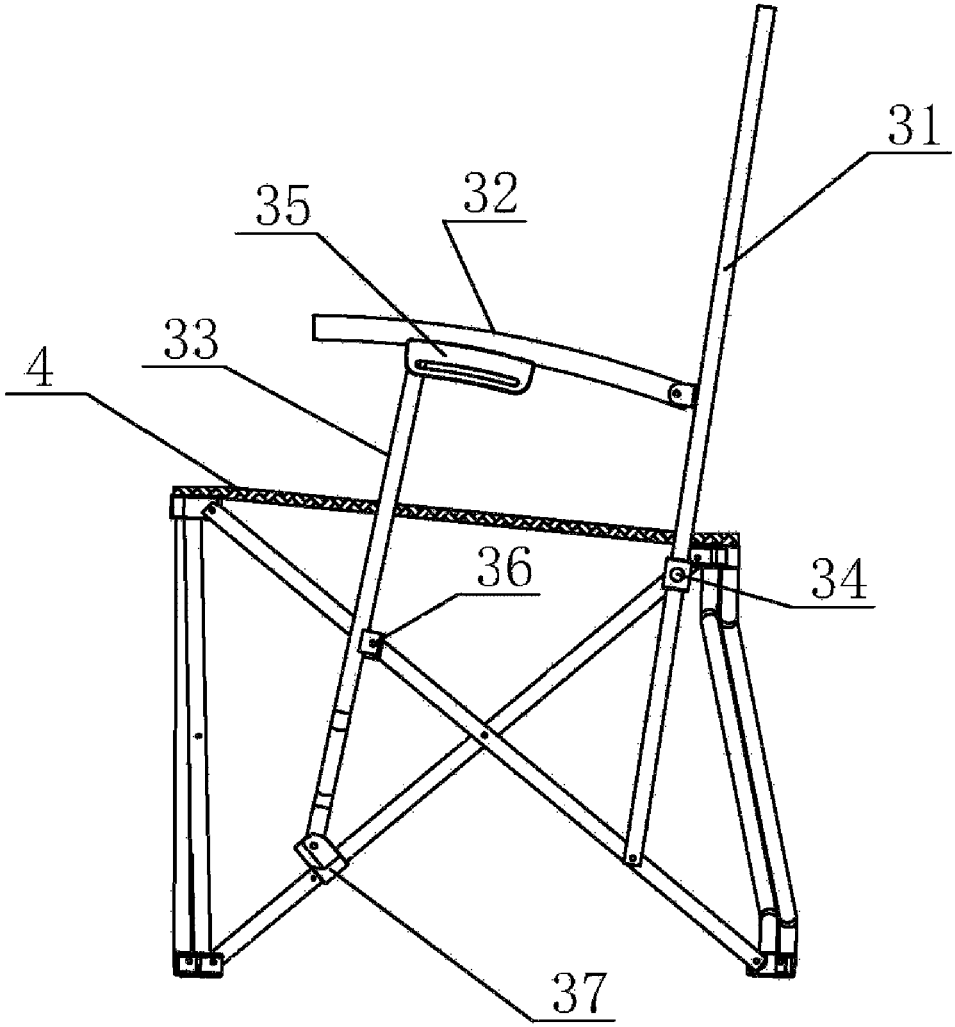
FIG. 1 is a schematic view showing the structure of a folding chair according to an embodiment of the present application in an unfolded state.
Figure 2:
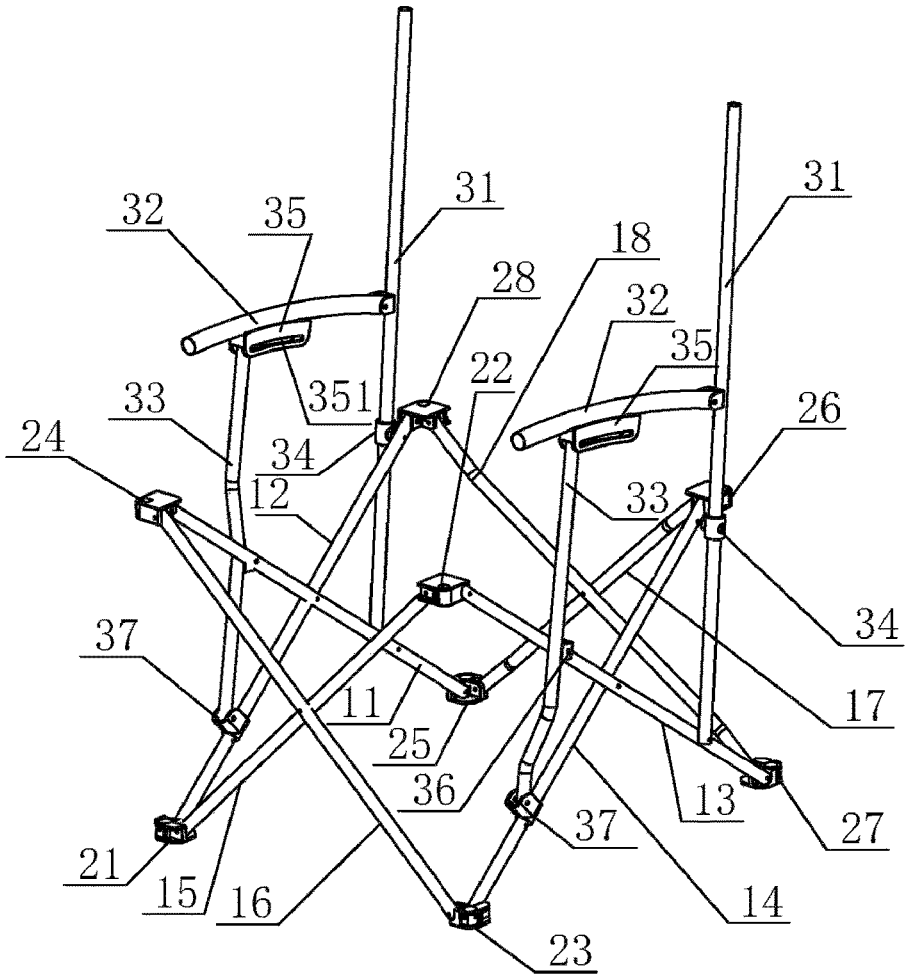
FIG. 2 is a schematic view showing the structure of a chair frame of the folding chair according to an embodiment of the present application in an unfolded state.
Figure 3:
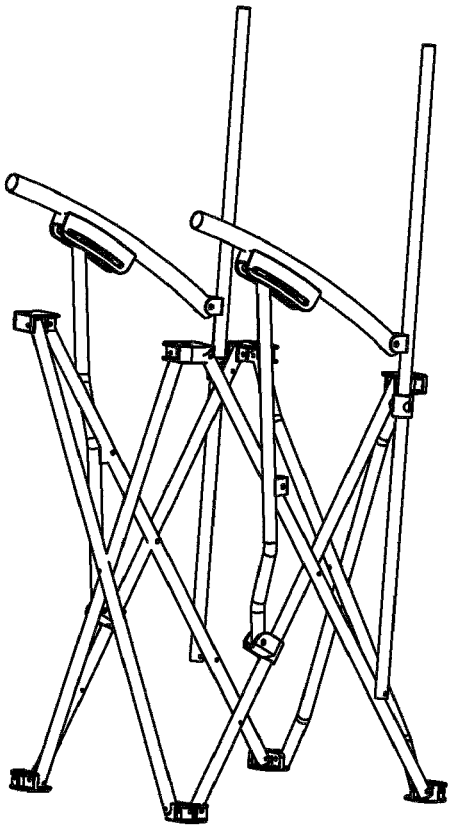
FIG. 3 is a schematic view showing the structure of the chair frame of the folding chair according to the embodiment of the present application in the process of being folded.
Figure 4:
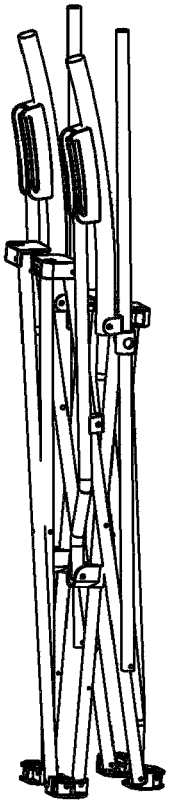
FIG. 4 is a schematic view showing the structure of the chair frame of the folding chair according to the embodiment of the present application in a folded state.

Referring to FIGS. 1 to 4, a folding chair with armrests according to this embodiment includes a chair frame and a fabric provided on the chair frame. The chair frame includes a left crossed tube structure and a right crossed tube structure. The left crossed tube structure is formed by a first left crossing tube 11 and a second left crossing tube 12 crossed with and hinged to each other. The right crossed tube structure is formed by a first right crossing tube 13 and a second right crossing tube 14 crossed with and hinged to each other. The chair frame further includes two backrest tubes 31, two armrest tubes 32 and two armrest support tubes 33. Lower ends of the two backrest tubes 31 are respectively hinged to the first left crossing tube 11 and the first right crossing tube 13. Backrest sliders 34 are respectively sleeved on middle portions of the two backrest tubes 31, and the backrest sliders 34 are hinged to the second left crossing tube 12 and the second right crossing tube 14 respectively. One end of each of the two armrest tubes 32 is hinged to the respective one of the two backrest tubes 31, and an upper end of each of the two armrest support tubes 33 is connected to the respective one of the two armrest tubes 32. During folding, each armrest tube 32 may rotate with respect to the respective backrest tube 31 by taking one end of the armrest tube 32 as a pivot point, so as to be folded, and the normal folding function of the folding chair will not be interfered. The chair frame further includes a front crossed tube structure and a rear crossed tube structure. The front crossed tube structure is formed by a first front crossing tube 15 and a second front crossing tube 16 crossed with and hinged to each other. The rear crossed tube structure is formed by a first rear crossing tube 17 and a second rear crossing tube 18 crossed with and hinged to each other. A lower end of the first front crossing tube 15 and a lower end of the second left crossing tube 12 are both hinged to a first hinging seat 21. An upper end of the first front crossing tube 15 and an upper end of the first right crossing tube 13 are both hinged to a second hinging seat 22. A lower end of the second front crossing tube 16 and a lower end of the second right crossing tube 14 are both hinged to a third hinging seat 23. An upper end of the second front crossing tube 16 and an upper end of the first left crossing tube 11 are both hinged to a fourth hinging seat 24. A lower end of the first rear crossing tube 17 and a lower end of the first left crossing tube 11 are both hinged to a fifth hinging seat 25. An upper end of the first rear crossing tube 17 and an upper end of the second right crossing tube 14 are both hinged to a sixth hinging seat 26. A lower end of the second rear crossing tube 18 and a lower end of the first right crossing tube 13 are both hinged to a seventh hinging seat 27. An upper end of the second rear crossing tube 18 and an upper end of the second left crossing tube 12 are both hinged to an eighth hinging seat 28. The second hinging seat 22, the fourth hinging seat 24, the sixth hinging seat 26 and the eighth hinging seat 28 are respectively fixedly connected to four corners of a seat fabric 4 for supporting a human body. Each of the two armrest tubes 32 has an armrest slider 35 fixed thereon, and the armrest slider 35 is provided with a sliding slot 351. An upper end of the respective armrest support tube 33 is slidably arranged in the sliding slot 351 of the armrest slider 35, thereby connecting the armrest support tube 33 to the armrest tube 32 by the armrest slider 35. Middle portions of the two armrest support tubes 33 are respectively hinged to the first left crossing tube 11 and the first right crossing tube 13. Two support tube slider 37 are respectively sleeved on the second left crossing tube 12 and the second right crossing tube 14, and the two support tube sliders 37 are respectively slidable on the second left crossing tube 12 and the second right crossing tube 14. A lower end of each of the two armrest support tubes 33 is hinged to the respective one of the two support tube sliders 37. When the folding chair is unfolded to be in a using state and is placed on a horizontal ground, the horizontal heights of the second hinging seat 22 and the fourth hinging seat 24 are higher than the horizontal heights of the sixth hinging seat 26 and the eighth hinging seat 28.

The above contents described in this specification are only illustrations to the present application. Various modifications or supplements, or similar substitutions may be made to the described embodiments by the person skilled in the art, and all those modifications, supplements or substitutions should fall into the scope of the present application as long as they do not depart from contents of the specification of the present application or exceed the scope defined by the claims.

What is claimed is:

1. A folding chair with armrests, comprising a chair frame and a fabric provided on the chair frame, the chair frame comprising a left crossed tube structure and a right crossed tube structure, the left crossed tube structure consisting of a first left crossing tube and a second left crossing tube crossed with and hinged to each other, and the right crossed tube structure consisting of a first right crossing tube and a second right crossing tube crossed with and hinged to each other, wherein, the chair frame further comprises two backrest tubes, two armrest tubes and two armrest support tubes, lower ends of the two backrest tubes are respectively hinged to the first left crossing tube and the first right crossing tube, two backrest sliders are respectively sleeved on middle portions of the two backrest tubes, and the two backrest sliders are respectively hinged to the second left crossing tube and the second right crossing tube, one end of each of the two armrest tubes is hinged to a respective one of the two backrest tubes, upper ends of the two armrest support tubes are respectively connected to the two armrest tubes, and lower ends of the two armrest support tubes are respectively connected to the second left crossing tube and the second right crossing tube; and wherein, an armrest slider is fixed on each of the two armrest tubes, the armrest slider is provided with a sliding slot, and an upper end of the respective armrest support tube is slidably arranged in the sliding slot of the armrest slider, to allow the armrest slider to connect the armrest support tube to the armrest tube; and wherein, middle portions of the two armrest support tubes are respectively hinged to the first left crossing tube and the first right crossing tube, two support tube sliders are respectively sleeved on the second left crossing tube and the second right crossing tube, and are respectively slidable on the second left crossing tube and the second right crossing tube, and lower ends of the two armrest support tubes are respectively hinged to the two support tube sliders.

2. The folding chair with armrests according to claim 1, wherein the chair frame further comprises a front crossed tube structure and a rear crossed tube structure, the front crossed tube structure consists of a first front crossing tube and a second front crossing tube crossed with and hinged to each other, the rear crossed tube structure consists of a first rear crossing tube and a second rear crossing tube crossed with and hinged to each other, a lower end of the first front crossing tube and a lower end of the second left crossing tube are both hinged to a first hinging seat, an upper end of the first front crossing tube and an upper end of the first right crossing tube are both hinged to a second hinging seat, a lower end of the second front crossing tube and a lower end of the second right crossing tube are both hinged to a third hinging seat, an upper end of the second front crossing tube and an upper end of the first left crossing tube are both hinged to a fourth hinging seat, a lower end of the first rear crossing tube and a lower end of the first left crossing tube are both hinged to a fifth hinging seat, an upper end of the first rear crossing tube and an upper end of the second right crossing tube are both hinged to a sixth hinging seat, a lower end of the second rear crossing tube and a lower end of the first right crossing tube are both hinged to a seventh hinging seat, an upper end of the second rear crossing tube and an upper end of the second left crossing tube are both hinged to an eighth hinging seat, and the second hinging seat, the fourth hinging seat, the sixth hinging seat and the eighth hinging seat are respectively fixedly connected to four corners of the seat fabric for supporting a human body.

3. The folding chair with armrests according to claim 2, wherein in a case that the folding chair is unfolded to be in a using state and is placed on a horizontal ground, horizontal heights of the second hinging seat and the fourth hinging seat are higher than horizontal heights of the sixth hinging seat and the eighth hinging seat.

4. A folding chair with armrests, comprising a chair frame, the chair frame comprising a left crossed tube structure and a right crossed tube structure, the left crossed tube structure consisting of a first left crossing tube and a second left crossing tube crossed with and hinged to each other, the right crossed tube structure consisting of a first right crossing tube and a second right crossing tube crossed with and hinged to each other, wherein the chair frame further comprises two backrest tubes, two armrest tubes and two armrest support tubes, lower ends of the two backrest tubes are respectively hinged to the first left crossing tube and the first right crossing tube, two backrest sliders are respectively sleeved on middle portions of the two backrest tubes, and the two backrest sliders are respectively hinged to the second left crossing tube and the second right crossing tube, one end of each of the two armrest tubes is hinged to a respective one of the two backrest tubes, upper ends of the two armrest support tubes are respectively connected to the two armrest tubes, and lower ends of the two armrest support tubes are respectively connected to the second left crossing tube and the second right crossing tube; and wherein, an armrest slider is fixed on each of the two armrest tubes, the armrest slider is provided with a sliding slot, and an upper end of the respective armrest support tube is slidably arranged in the sliding slot of the armrest slider, to allow the armrest slider to connect the armrest support tube to the armrest tube; and wherein, middle portions of the two armrest support tubes are respectively hinged to the first left crossing tube and the first right crossing tube, two support tube sliders are respectively sleeved on the second left crossing tube and the second right crossing tube, and are respectively slidable on the second left crossing tube and the second right crossing tube, and lower ends of the two armrest support tubes are respectively hinged to the two support tube sliders.

5. The folding chair with armrests according to claim 4, wherein the chair frame further comprises a front crossed tube structure and a rear crossed tube structure, the front crossed tube structure consists of a first front crossing tube and a second front crossing tube crossed with and hinged to each other, the rear crossed tube structure consists of a first rear crossing tube and a second rear crossing tube crossed with and hinged to each other, a lower end of the first front crossing tube and a lower end of the second left crossing tube are both hinged to a first hinging seat, an upper end of the first front crossing tube and an upper end of the first right crossing tube are both hinged to a second hinging seat, a lower end of the second front crossing tube and a lower end of the second right crossing tube are both hinged to a third hinging seat, an upper end of the second front crossing tube and an upper end of the first left crossing tube are both hinged to a fourth hinging seat, a lower end of the first rear crossing tube and a lower end of the first left crossing tube are both hinged to a fifth hinging seat, an upper end of the first rear crossing tube and an upper end of the second right crossing tube are both hinged to a sixth hinging seat, a lower end of the second rear crossing tube and a lower end of the first right crossing tube are both hinged to a seventh hinging seat, an upper end of the second rear crossing tube and an upper end of the second left crossing tube are both hinged to an eighth hinging seat.

6. The folding chair with armrests according to claim 5, wherein in a case that the folding chair is unfolded to be in a using state and is placed on a horizontal ground, horizontal heights of the second hinging seat and the fourth hinging seat are higher than horizontal heights of the sixth hinging seat and the eighth hinging seat.

* * * * *